US006662594B2

(12) United States Patent
Rampp et al.

(10) Patent No.: US 6,662,594 B2
(45) Date of Patent: Dec. 16, 2003

(54) APPARATUS AND PROCESS FOR PRODUCING GASEOUS OXYGEN UNDER ELEVATED PRESSURE

(75) Inventors: Augustin Rampp, Iffeldorf (DE); Michael Lauter, Augsburg (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 10/319,582

(22) Filed: Dec. 16, 2002

(65) Prior Publication Data

US 2003/0110796 A1 Jun. 19, 2003

(30) Foreign Application Priority Data

Dec. 14, 2001 (DE) ..... 101 61 584

(51) Int. Cl.[7] ..... F25J 3/04
(52) U.S. Cl. ..... 62/643; 62/654; 62/905
(58) Field of Search ..... 62/643, 646, 654, 62/902, 903, 905

(56) References Cited

U.S. PATENT DOCUMENTS

| | | | | |
|---|---|---|---|---|
| 4,560,398 A | * | 12/1985 | Beddome et al. | 62/646 |
| 4,702,757 A | * | 10/1987 | Kleinberg | 62/646 |
| 4,704,147 A | * | 11/1987 | Kleinberg | 62/646 |
| 4,781,739 A | * | 11/1988 | Erickson | 62/651 |
| 4,817,394 A | * | 4/1989 | Erickson | 62/646 |
| 5,386,692 A | * | 2/1995 | Laforce | 62/646 |
| 5,410,885 A | * | 5/1995 | Smolarek et al. | 62/646 |
| 5,979,182 A | * | 11/1999 | Goto et al. | 62/643 |

* cited by examiner

*Primary Examiner*—William C. Doerrler
(74) *Attorney, Agent, or Firm*—Millen, White, Zelano & Branigan, P.C.

(57) ABSTRACT

An apparatus and process for producing gaseous oxygen under elevated pressure utilize a distillation column system which has a high-pressure column (106), a low-pressure column (107) located above the high-pressure column (106), and a side condenser (102), which has a liquefaction space and a vaporization space, used to vaporize a liquid oxygen fraction from the low-pressure column (107). The side condenser (102) is located below the high-pressure column (106).

19 Claims, 3 Drawing Sheets

APPARATUS AND PROCESS FOR PRODUCING GASEOUS OXYGEN UNDER ELEVATED PRESSURE

The invention relates to an apparatus for producing gaseous oxygen under elevated pressure with a distillation column system, which has a high-pressure column and a low-pressure column, the low-pressure column being located above the high-pressure column, with a side condenser, which has a liquefaction space and a vaporization space and which is located below the bottom of the low-pressure column, with a feed air line, which is connected to the high-pressure column, with at least one transition line for introducing a fraction from the high-pressure column into the low-pressure column, with a liquid line for removing a liquid oxygen fraction from the low-pressure column, the liquid line leading into the vaporization space of the side condenser, and with a product line for gaseous oxygen under elevated pressure, which is connected to the vaporization space of the condenser-vaporizer.

The distillation column system, for example a Linde double-column system, is used for low-temperature separation of feed air into oxygen and nitrogen. The principles of low-temperature separation of air in general and the structure of the double-column system in particular are described in the monograph "Low-Temperature Technology" by Hausen/Linde (2nd Edition, 1985) and in an article by Latimer in Chemical Engineering Progress (Vol. 63, No. 2, 1967, page 35). The high-pressure column and the low-pressure column are generally in a heat exchange relationship via a main condenser in which the top gas of the high-pressure column is liquefied against the vaporizing bottom liquid of the low-pressure column.

An apparatus of the initially mentioned type is known from DE 2323941 A, EP 384483 B1 (U.S. Pat. No. 5,036,672) and EP 1074805 A1 (U.S. Pat. No. 6,332,337). The side condenser is used for vaporization. It is conventionally located next to the high-pressure column.

The distillation column system and the side condenser, generally also a main heat exchanger for cooling the feed air and optionally a supercooling countercurrent heat exchanger, must be insulated against the entry of heat. To do this, generally one or more powder (perlite)-filled jackets, so-called cold boxes, are used.

Here, the "side condenser" is a condenser-vaporizer, which is located outside the low-pressure column, and its vaporization side during system operation is under a higher pressure than the low-pressure column. The oxygen vaporized there is then obtained under a correspondingly increased pressure as a gaseous product. The pressure increase is caused by the geodetic gradient (and optionally in addition by a pump). The side condenser is preferably made as a liquid bath vaporizer (circulation vaporizer): A plate heat exchanger block contains vaporization and liquefaction passages. It is located in a tank, which is partially filled during operation with the liquid to be vaporized. The liquid is overturned by means of the thermosiphon effect through the vaporization passages of the plate heat exchanger block. The vaporization space is formed by these vaporization passages and by the outside space between the block and tank wall, and the liquefaction space is formed by the liquefaction passages.

An object of the invention is to provide an apparatus of the initially mentioned type which is especially economical and especially particularly compact.

Upon further study of the specification and appended claims, further objects and advantages of this invention will become apparent to those skilled in the art.

For this purpose, it was conventional in the past for all apparatus parts, even for the columns to be placed next to one another (see, for example, DE 19904526 or U.S. Pat. No. 6,148,637).

In accordance with the invention, these objects are achieved by locating the side condenser below the high-pressure column. "Below one another" here means that the cross sections of the two apparatus parts intersect in the projection onto the horizontal plane, "horizontal" relating to the orientation of these parts during operation. The cross sections of the side condenser and the high-pressure column overlap in this sense, for example, in part or completely. Preferably, the side condenser, the high-pressure column and the low-pressure column are located in a line below one another. A common cold box, which can encompass all three apparatus types, can thus be made especially compact and thus economical. Another advantage arises by the greater vertical distance between the low-pressure column and the side condenser. The pressure increase that arises solely by the gradient between the low-pressure column and side condenser is, therefore, without supplying energy from the outside, accordingly more dramatic. The gaseous oxygen product can therefore be obtained under an especially high pressure, for example, 1.5 to 3.5 bar, preferably 2 to 2.8 bar. Here, the operating pressure of the columns of the distillation column system (each at the top) is, for example, 5 to 9 bar, preferably 6.0 to 7.5 bar in the high-pressure column and, for example, 1.3 to 2.0 bar, preferably 1.5 to 1.8 bar in the low-pressure column.

Preferably, the low-pressure column, the high-pressure column and the side condenser are arranged in a line below one another.

Preferably, the feed air line is routed through the liquefaction space of the side condenser. The feed air is thus used as a heating means for the vaporization of the liquid oxygen fraction and in doing so partially or completely condenses.

Here, it is favorable if the feed air line and the side condenser are designed such that during operation of the device, the feed air is only partially condensed in the side condenser, for example, 30 mole % or less, preferably 25 to 30 mole %. Thus, on the one hand, all the feed air (optionally minus the amount of turbine air) can be routed through the side condenser, and other feed air lines are unnecessary. On the other hand, for only partial condensation, a higher vaporization temperature at the same pressure is reached; conversely, a lower air pressure is sufficient at the same oxygen product pressure. The pressure in the liquefaction space of the side condenser is preferably 6 to 8 bar. The partially condensed feed air from the side condenser can be fed into a separator (phase separator), which is located, for example, directly next to the side condenser within the cold box.

Any air separation system has a main heat exchanger for cooling the feed air against product flows. In the inventive device, it is favorable if this main heat exchanger is located below the high-pressure column, especially between the high-pressure column and the side condenser. In this way, the main heat exchanger can be encompassed by the common, compact cold box. Separate insulation and a bulky configuration of the box can be avoided. The additional height of the main heat exchanger entails an additional pressure increase in the oxygen product.

Often the feed liquid(s) for the low-pressure column is(are) supercooled against the gas product(s) of the low-pressure column by indirect heat exchange in a supercooling countercurrent heat exchanger. Within the framework of the invention, it is advantageous if this additional heat exchanger is located likewise between the high-pressure column and the side condenser. It can thus likewise be encompassed by a common, compact cold box. Separate insulation and a bulky configuration of the box can be avoided. The additional height of the main heat exchanger entails an additional pressure increase in the oxygen product.

Preferably, the apparatus parts are located directly on top of one another in the following sequence: side condenser (optionally with a separator)-supercooling countercurrent heat exchanger-main heat exchanger-high-pressure column-low-pressure column.

The invention relates, moreover, to a process for producing gaseous oxygen under elevated pressure. The process comprises:

introducing a feed gas into the high-pressure column;

introducing at least one fraction from the high-pressure column into the low-pressure column;

introducing a liquid oxygen fraction from the low-pressure column into a vaporization space of a side condenser, the side condenser having a liquefaction space and a vaporization space and is located below the bottom of the low-pressure column; and withdrawing gaseous oxygen from the vaporization space of the side condenser, wherein the side condenser is located below the high-pressure column.

Preferably, the low-pressure column (107), the high-pressure column (106) and the side condenser (102) are located in a line below one another. In addition, according to a further aspect of the process, at least a part of the feed air (1, 2, 4) is routed through the liquefaction space of the side condenser (102). Further, it is advantageous for the feed air to be only partially condensed in the side condenser (102).

In the process, the feed air (1) is preferably cooled in a main heat exchanger (105) against product flows (21, 23, 26), wherein the main heat exchanger (105) is located below the high-pressure column (106), especially between the high-pressure column (106) and the side condenser (102). Also, in accordance with another aspect of the invention, at least one gaseous product flow (21, 23) is withdrawn from the low-pressure column (107) and heated in a supercooling countercurrent heat exchanger (104) against the fraction (18–19, 11–14–15) from the high-pressure column (106), the supercooling countercurrent heat exchanger (104) being located between the high-pressure column (106) and the side condenser (102).

The entire disclosure of all applications, patents and publications, cited above and below, and of corresponding German Application No. 101 61 584.1, filed Dec. 13, 2002 is hereby incorporated by reference.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar components or process steps throughout the several views, and wherein:

FIG. 1 schematically shows the three-dimensional structure of an apparatus as claimed in the invention. Details such as pipelines, valves, measurement and actuating means are not shown.

Figure 1:
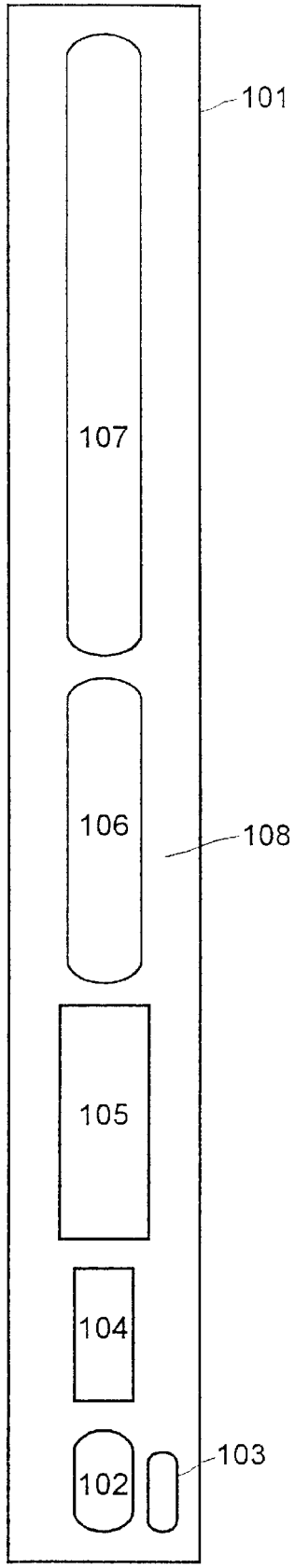
FIG. 1 shows a sample three-dimensional arrangement of the different apparatus parts.

Within the cuboidal or cylindrical cold box 101, all apparatus parts that require heat insulation are housed on top of one another. Lowermost are a side condenser 102 and the pertinent separator 103 on the bottom. On top of them, in succession, are the supercooling countercurrent heat exchanger 104, the main heat exchanger 105, the high-pressure column 106 and the low-pressure column 107. The intermediate space 108 between the apparatus and the cold box wall is filled with insulating powder (perlites).

The supercooling countercurrent heat exchanger 104 and the main heat exchanger 105 can also be made as a common, integrated heat exchanger block (not shown in FIG. 1).

Figure 2:
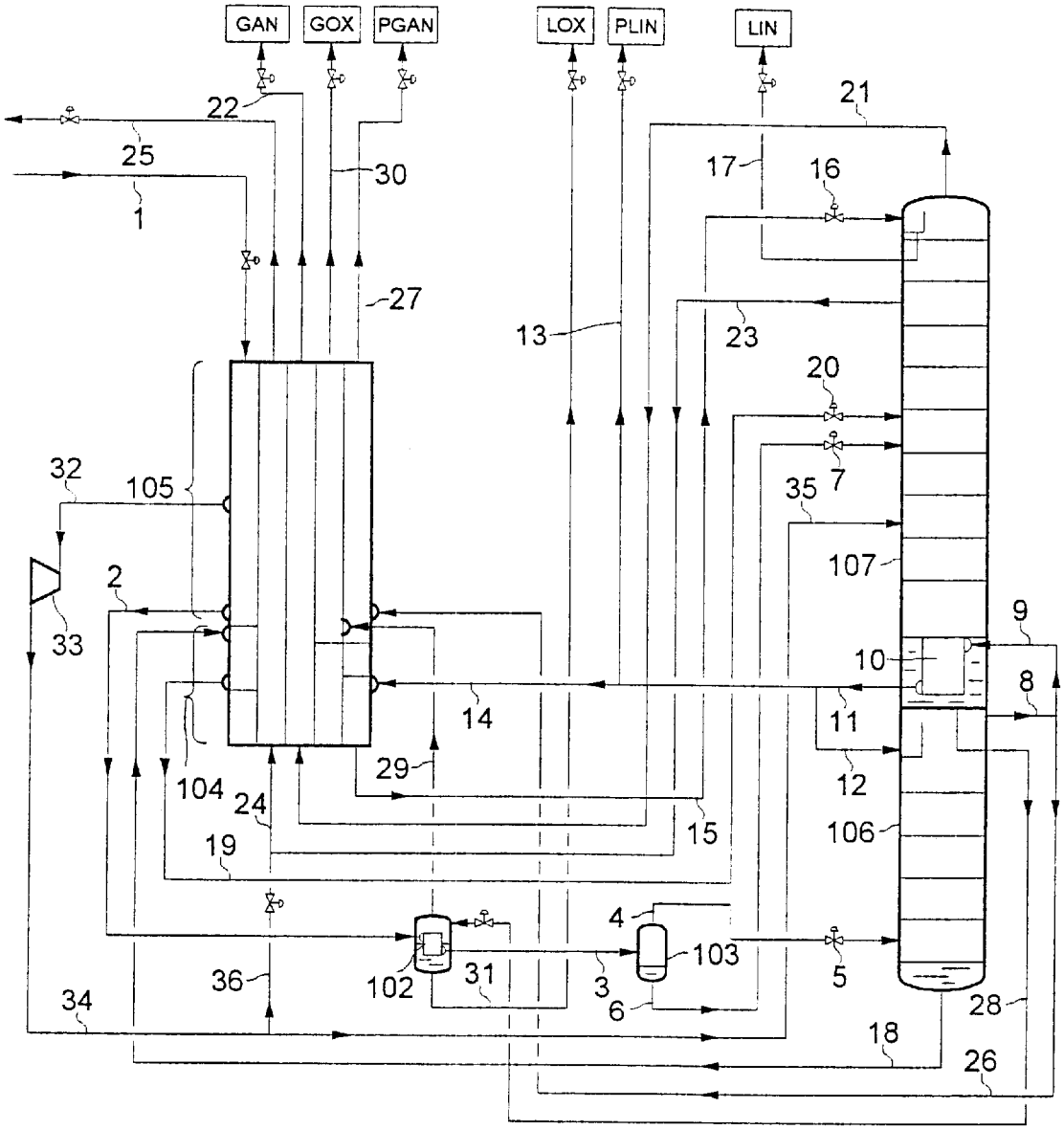
FIGS. 2 and 3 show two embodiments of the invention with details for the sequence of process steps, with cold generation by the use of turbine(s) (FIG. 2) or with cold being supplied from outside the system (FIG. 3).
Figure 3:
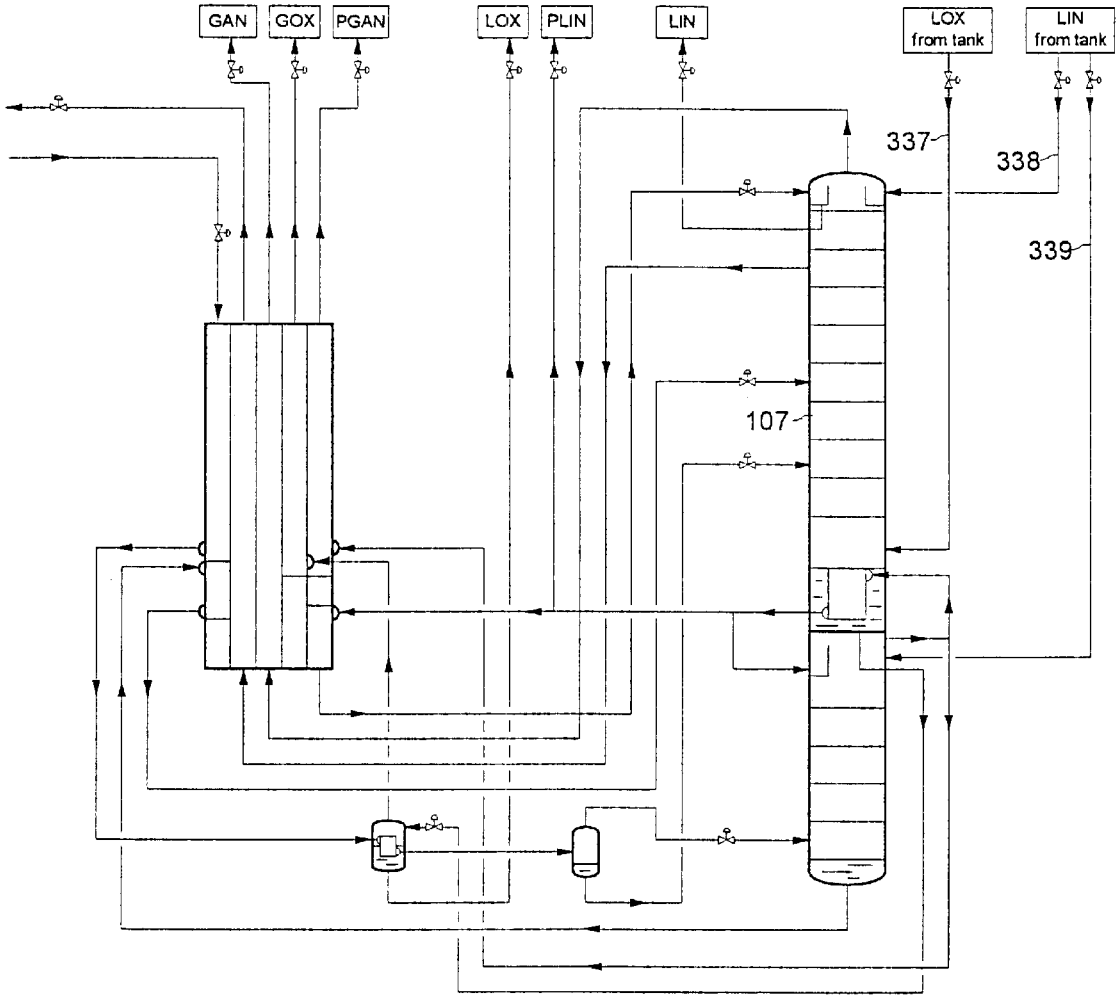

FIGS. 2 and 3 do not completely show the three-dimensional arrangement of the apparatus parts. The construction shown in FIG. 1 applies thereto.

In the embodiment from FIG. 2, compressed and purified air 1 is delivered under a pressure of, for example, 8.2 bar and enters a main heat exchanger 105 on the hot end. Most of the air is removed via the line 2 on the cold end of the main heat exchanger 105 and supplied to the liquefaction space of a side condenser 102. There the air partially condenses. Via the line 3, a two-phase mixture from the side condenser 102 that contains roughly 26 mole % liquid emerges. It is delivered into a separator 103. The portion of the air 4 that has remained gaseous is choked to roughly 6 bar (5) and fed into the high-pressure column 106 of a distillation column system, which, moreover, has a low-pressure column 107. (The lines 1, 2, 3 and 4 in the embodiment represent the "feed air line.") The liquid 6 is introduced into the low-pressure column 107 after passing through another choke valve 7 under roughly 1.5 bar.

The gaseous top nitrogen 8 of the high-pressure column 106 is condensed at least in a part 9 in a main condenser against the vaporizing bottom liquid of the low-pressure column 107. The liquid nitrogen 11 formed thereby is returned in a first part 12 as reflux to the high-pressure column 106. A second part 14 is supercooled in a supercooling countercurrent heat exchanger 104 and delivered to the head of the low-pressure column 107 via the line 15 and valve 16. (The supercooling countercurrent heat exchanger 104 and the main heat exchanger 105 are made in the embodiment as an integrated heat exchanger block.) The liquid nitrogen 15 is used mainly as reflux in the low-pressure column 107, but it can also be removed in one part 17 as unpressurized liquid product (LIN). Another part 13 of the liquid nitrogen 11 from the main condenser 10 can be withdrawn as a pressurized liquid product (PLIN).

The bottom liquid 18 of the high-pressure column 106 is transferred via the supercooling countercurrent heat exchanger 104, the line 19 and the valve 20 into the low-pressure column ("transition line").

As the gaseous products of the low-pressure column 107, clean and dirty nitrogen are routed via the product line 21/22 or via the residual gas line 23/24/25 through the supercooling countercurrent heat exchanger 104 and the main heat exchanger 105 and finally withdrawn as product (GAN) or blown out into the atmosphere or used as regeneration gas in a molecular sieve system for cleaning the air (not shown). A product can also be obtained directly from the high-pressure column. To do this, a part 26 of the top nitrogen 8 is heated in the main heat exchanger 105 and is obtained as the gaseous pressurized nitrogen product 27 (PGAN).

From the bottom of the low-pressure column 107, a liquid oxygen fraction 28 is withdrawn, undergoes a hydrostatic pressure increase and is fed into the vaporization space of the side condenser 102 and is partially vaporized there. The gaseous oxygen 29 that is formed here is routed to the main heat exchanger and finally routed via the line 30 as a compressed gas product (GOX) to a consumer. The oxygen that has remained liquid is withdrawn as the flushing liquid 31 from the vaporization space of the side condenser 102 and either discarded or (as shown in FIG. 2) recovered as a liquid product (LOX); alternatively or in addition injection into the line 30 is possible.

The cold necessary for equalization of the insulation losses and for product liquefaction is produced in the embodiment of FIG. 2 by the relief of a process flow performing work. To do this, a partial flow 32 of the feed air 1 is withdrawn from the main heat exchanger 105 at an intermediate temperature, supplied to a relief machine (for example, turbine) 33; there it is relieved to roughly the operating pressure of the low-pressure column 107 and fed into the low-pressure column 107 via the lines 34 and 35. In particular, at relatively high liquid production, a part 36 of the turbine air 34 can be mixed with the residual gas 23 and can be jointly removed with it from the process.

FIG. 3 differs from FIG. 2 by the divergent form of cold supply. Here, a turbine is abandoned. The cold requirement is instead covered by liquid from the outside (liquid assist). To do this, liquid oxygen 337 is introduced from a liquid tank into the lower area of the low-pressure column 107. The feed of supercold liquid from a nitrogen-liquid tank is alternative or additional. The liquid nitrogen can be introduced via the line 338 into the upper area of the low-pressure column 107 and/or via the line 339 into the upper area of the high-pressure column 106. Likewise, liquefied air or any other liquid mixture of air components can be used to meet the cold demand.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. An apparatus for producing gaseous oxygen under elevated pressure comprising:

a distillation column system having a high-pressure column (106) and a low-pressure column (107), the low-pressure column (107) being located above the high-pressure column (106);

a side condenser (102) having a liquefaction space and a vaporization space and which is located below the bottom of the low-pressure column (107);

a feed air line (1, 2, 3, 4), which is connected to the high-pressure column (106);

at least one transition line (18–19; 11–14–15) for introducing a fraction from the high-pressure column (106) into the low-pressure column (107);

a liquid line (28) for removing a liquid oxygen fraction from the low-pressure column (107), the liquid line (28) leading into the vaporization space of the side condenser (102); and a product line (29, 30), for removing gaseous oxygen under elevated pressure, which is connected to the vaporization space of the said side condenser (102);

wherein the side condenser (102) is located below the high-pressure column (106), and wherein the low-pressure column (107), the high-pressure column (106) and the side condenser (102) are located below one another.

2. An apparatus according to claim 1, wherein the feed air line (1, 2, 3, 4) is in fluid communication with the liquefaction space of the side condenser (102).

3. An apparatus according to claim 2, wherein the feed air line (1, 2, 3, 4) and the side condenser (102) are adapted to only made partially condensed the feed air in the side condenser (102).

4. An apparatus according to claim 1, wherein the feed air line (1, 2, 3, 4) is in fluid communication with a main heat exchanger (105) wherein feed air is cooled by heat exchange with product streams, and the main heat exchanger (105) is located below the high-pressure column (106).

5. An apparatus according to claim 4, wherein the main heat exchanger (105) is located between the high-pressure column (106) and the side condenser (102).

6. An apparatus according to claim 1, wherein a gas product line (21–22, 23–24–25) for removing a gaseous product from the low-pressure column (107), is connected to a supercooling countercurrent heat exchanger (104) located between the high-pressure column (106) and the side condenser (102), and the transition line (18–19; 11–14–15) is in fluid communication with the supercooling countercurrent heat exchanger (104).

7. A process for producing gaseous oxygen under elevated pressure in a distillation column system, having a high-pressure column (106) and a low-pressure column (107), the low-pressure column (107) being located above the high-pressure column (106), said process comprising:

introducing a feed gas (1, 2, 3, 4) into the high-pressure column (106);

introducing at least one fraction (18–19; 11–14–15) from the high-pressure column (106) into the low-pressure column (107);

introducing a liquid oxygen fraction from the low-pressure column (107) into a vaporization space of a side condenser (102), said side condenser having a liquefaction space and a vaporization space and is located below the bottom of the low-pressure column (107); and withdrawing gaseous oxygen (29, 30) from the vaporization space of the side condenser (102), wherein the side condenser (102) is located below the high-pressure column (106), and wherein the low-pressure column (107), the high-pressure column (106) and the side condenser (102) are located below one another.

8. A process according to claim 7, wherein at least a part of the feed air (1, 2, 4) is routed through the liquefaction space of the side condenser (102).

9. A process according to claim 8, wherein the feed air is only partially condensed in the side condenser (102).

10. A process according to claim 7, wherein the feed air (1) is cooled in a main heat exchanger (105) against product flows (21, 23, 26), and the main heat exchanger (105) is located below the high-pressure column (106).

11. A process according to claim 10, wherein the main heat exchanger (105) is located between the high-pressure column (106) and the side condenser (102).

12. A process according to claim 7, wherein at least one gaseous product flow (21, 23) is withdrawn from the low-pressure column (107) and is heated in a supercooling countercurrent heat exchanger (104) against the fraction (18–19, 11–14–15) from the high-pressure column (106), the supercooling countercurrent heat exchanger (104) being located between the high-pressure column (106) and the side condenser (102).

13. An apparatus for producing gaseous oxygen under elevated pressure comprising:

a distillation column system having a high-pressure column (106) and a low-pressure column (107), the low-pressure column (107) being located above the high-pressure column (106);

a side condenser (102) having a liquefaction space and a vaporization space and which is located below the bottom of the low-pressure column (107);

a feed air line (1, 2, 3, 4), which is connected to the high-pressure column (106);

at least one transition line (18–19; 11–14–15) for introducing a fraction from the high-pressure column (106) into the low-pressure column (107);

a liquid line (28) for removing a liquid oxygen fraction from the low-pressure column (107), the liquid line (28) leading into the vaporization space of the side condenser (102); and a product line (29, 30), for removing gaseous oxygen under elevated pressure, which is connected to the vaporization space of the said side condenser (102);

wherein the side condenser (102) is located below the high-pressure column (106), and wherein the feed air line (1, 2, 3, 4) is in fluid communication with the main heat exchanger (105) wherein feed air is cooled by heat exchange with product streams, and the main heat exchanger (105) is located below the high-pressure column (106).

14. An apparatus for producing gaseous oxygen under elevated pressure comprising:

a distillation column system having a high-pressure column (106) and a low-pressure column (107), the low-pressure column (107) being located above the high-pressure column (106);

a side condenser (102) having a liquefaction space and a vaporization space and which is located below the bottom of the low-pressure column (107);

a feed air line (1, 2, 3, 4), which is connected to the high-pressure column (106);

at least one transition line (18–19; 11–14–15) for introducing a fraction from the high-pressure column (106) into the low-pressure column (107);

a liquid line (28) for removing a liquid oxygen fraction from the low-pressure column (107), the liquid line (28) leading into the vaporization space of the side condenser (102); and a product line (29, 30), for removing gaseous oxygen under elevated pressure, which is connected to the vaporization space of the said side condenser (102);

wherein the side condenser (102) is located below the high-pressure column (106), and wherein a gas product line (21–22, 23–24–25) for removing a gaseous product from the low-pressure column (107), is connected to a supercooling countercurrent heat exchanger (104) located between the high-pressure column (106) and the side condenser (102), and the transition line (18–19; 11–14–15) is in fluid communication with the supercooling countercurrent heat exchanger (104).

15. A process for producing gaseous oxygen under elevated pressure in a distillation column system, having a high-pressure column (106) and a low-pressure column (107), the low-pressure column (107) being located above the high-pressure column (106), said process comprising:

introducing a feed gas (1, 2, 3, 4) into the high-pressure column (106);

introducing at least one fraction (18–19; 11–14–15) from the high-pressure column (106) into the low-pressure column (107);

introducing a liquid oxygen fraction from the low-pressure column (107) into a vaporization space of a side condenser (102), said side condenser having a liquefaction space and a vaporization space and is located below the bottom of the low-pressure column (107); and withdrawing gaseous oxygen (29, 30) from the vaporization space of the side condenser (102), wherein the side condenser (102) is located below the high-pressure column (106), and wherein the feed air (1) is cooled in a main heat exchanger (105) against product flows (21, 23, 26), and the main heat exchanger (105) is located below the high-pressure column (106).

16. A process for producing gaseous oxygen under elevated pressure in a distillation column system, having a high-pressure column (106) and a low-pressure column (107), the low-pressure column (107) being located above the high-pressure column (106), said process comprising:

introducing a feed gas (1, 2, 3, 4) into the high-pressure column (106);

introducing at least one fraction (18–19; 11–14–15) from the high-pressure column (106) into the low-pressure column (107);

introducing a liquid oxygen fraction from the low-pressure column (107) into a vaporization space of a side condenser (102), said side condenser having a liquefaction space and a vaporization space and is located below the bottom of the low-pressure column (107); and withdrawing gaseous oxygen (29, 30) from the vaporization space of the side condenser (102), wherein the side condenser (102) is located below the high-pressure column (106), and wherein at least one gaseous product flow (21, 23) is withdrawn from the low-pressure column (107) and is heated in a supercooling countercurrent heat exchanger (104) against the fraction (18–19, 11–14–15) from the high-pressure column (106), the supercooling countercurrent heat exchanger (104) being located between the high-pressure column (106) and the side condenser (102).

17. A process according to claim 7, wherein said gaseous oxygen (29, 30) is withdrawn at a pressure of 1.5–3.5 bar.

18. A process according to claim 7, wherein said high-pressure column (106) operates at a pressure of 5–9 bar.

19. A process according to claim 7, wherein said and a low-pressure column (107) operates at a pressure of 1.3–2.0 bar.

* * * * *